United States Patent [19]

Dwyer

[11] 4,063,506

[45] Dec. 20, 1977

[54] HOLDER FOR USE WITH DEVICE FOR IMPRINTING INDICIA ON A FLEXIBLE ARTICLE

[76] Inventor: James F. Dwyer, 47 Kenyon St., Providence, R.I. 02903

[21] Appl. No.: 735,804

[22] Filed: Oct. 26, 1976

Related U.S. Application Data

[60] Division of Ser. No. 589,784, June 23, 1975, Pat. No. 3,992,988, which is a continuation-in-part of Ser. No. 538,421, Jan. 3, 1975, Pat. No. 4,004,503.

[51] Int. Cl.[2] ..... B41J 3/46; B41F 1/34

[52] U.S. Cl. ..... 101/407 BP; 101/41.9; 197/142

[58] Field of Search .... 101/407 R, 407 BP, DIG. 12, 101/9, 21, 27, 269, 35, 41, 42; 269/303, 315; 271/226, 239, 253, 255; 197/6, 6.2, 6.3, 6.4, 6.5, 6.6, 6.7, 140, 144

[56] References Cited

U.S. PATENT DOCUMENTS

| | | | |
|---|---|---|---|
| 891,150 | 6/1908 | Crowley | 101/407 BP |
| 1,026,171 | 5/1912 | Miller | 197/142 |
| 1,299,403 | 4/1919 | Fengler | 197/142 |
| 1,971,202 | 8/1934 | Smith | 197/142 |
| 3,140,658 | 7/1964 | Marshall | 101/407 BP |
| 3,740,881 | 6/1973 | Finger | 40/125 H |

*Primary Examiner*—Edgar S. Burr
*Assistant Examiner*—William Pieprz
*Attorney, Agent, or Firm*—Salter & Michaelson

[57] ABSTRACT

A holder for use in a device for imprinting indicia on a flexible article such as a duffel bag, tote bag, T-shirt or the like through the application of heat, the holder being positively located for positioning indicia strips in proper oriented position in overlying relation on the article. A heating block is movable into positive engagement with the indicia strips as they overlie the article, wherein indicia is transferred from the strips by heat of the heating block onto the article for the permanent imprinting thereon.

7 Claims, 3 Drawing Figures

HOLDER FOR USE WITH DEVICE FOR IMPRINTING INDICIA ON A FLEXIBLE ARTICLE

This is a division of application Ser. No. 589,784, filed June 23, 1975 now U.S. Pat. No. 3,992,988 and entitled HOLDER FOR USE WITH DEVICE FOR IMPRINTING INDICIA ON A FLEXIBLE ARTICLE, which is a continuation-in-part of application Ser. No. 538,421, filed Jan. 3, 1975 now U.S. Pat. No. 4,004,503 and entitled DEVICE FOR IMPRINTING INDICIA ON A FLEXIBLE ARTICLE.

BACKGROUND OF THE INVENTION

The present invention relates to a holder for use in a portable device for transferring indicia from a carrier onto a flexible article by the application of heat thereto.

The application of indicia such as identifying lettering or numbers and designs to flexible articles such as duffel bags, tote bags, articles of clothing and the like has usually been accomplished heretofore upon purchase of the article in a retail establishment by either ink stenciling or monograming by embroidery or by ironing individual letters onto the article. Although ink stenciling of indicia onto flexible articles accomplished the purpose intended, this technique was somewhat laborious and required special stenciling equipment and ink that necessitated appropriate skills on the part of the individual who applied the indicia to the flexible article. Some commercial processes for imprinting indicia or designs on flexible articles also accomplished the purpose intended, but necessarily had to be performed at a location where appropriate equipment was available for use. This kind of equipment was obviously complicated and expensive and could not be employed in a retail establishment.

Prior to the instant invention some efforts have been made to employ transfer printing techniques that utilize heat for transferring indicia to flexible articles. This technique had certain advantages in that the indicia as transferred was relatively permanent as applied, but the indicia had to be individually transferred usually with a hand iron and was not only laborious but produced inconsistent and unsatisfactory results. Other devices known heretofore have also utilized the heat transfer principle for transferring indicia onto flexible articles, but these devices were relatively complicated and expensive, which economically prohibited the wide spread use thereof.

SUMMARY OF THE INVENTION

The holder as embodied in the present invention is used with an imprinting device that provides for imprinting indicia on a flexible article such as a tote bag, duffel bag, T-shirt, and the like and includes a base on which a pad for receiving the article thereon is mounted, the pad defining an imprinting station. Stop means are located adjacent to the pad and imprinting station for positively locating the article in oriented imprinting position at the imprinting station. With the article located in oriented position at the imprinting station, the indicia holder is placed in position as determined by the stop means, which properly locates indicia strips carried by the holder in aligned and oriented position in overlying relation on the article. With the indicia strips properly located in engagement with the article, a heating member mounted on the base is moved into positive engagement with the indicia strips. The indicia is formed of a special ink that is heat responsive for transfer onto the article, and as transferred the indicia will remain on the article substantially for the life thereof.

Accordingly, it is an object of the present invention to provide a holder for use in a portable imprinting device for evenly transferring indicia in aligned and oriented relation onto a flexible article by the application of heat thereto.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENTS OF THE INVENTION

Figure 1:
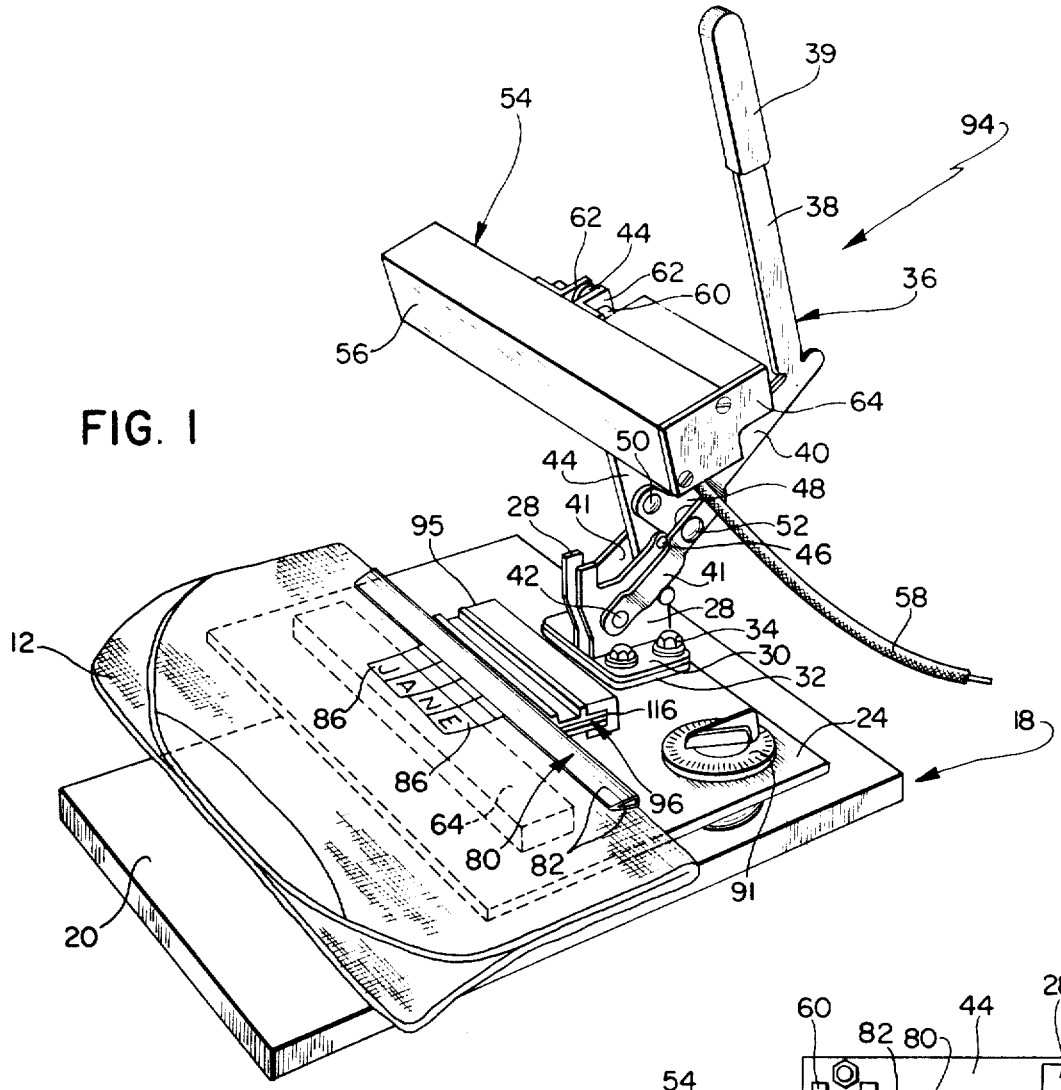
FIG. 1 is a perspective view of the portable indicia imprinting device as embodied in the subject invention and showing the position of a holder that positively locates a duffel bag thereon just prior to the imprinting operation.

Referring now to the drawings and particularly to FIG. 1, the imprinting device that is used in the present invention is illustrated and is generally indicated at 94. As shown, the imprinting device 94 is utilized for imprinting indicia such as lettering, numerals, designs and the like on flexible articles, an example of which is a duffel bag. The duffel bag can be formed of any conventional cloth material and normally includes a draw string having ends that extend outwardly of grommeted openings to provide a closure for the bag. A more complete illustration of the duffel bag and a tote bag on which indicia are imprinted is disclosed in co-pending application Ser. No. 589,784.

Figure 2:
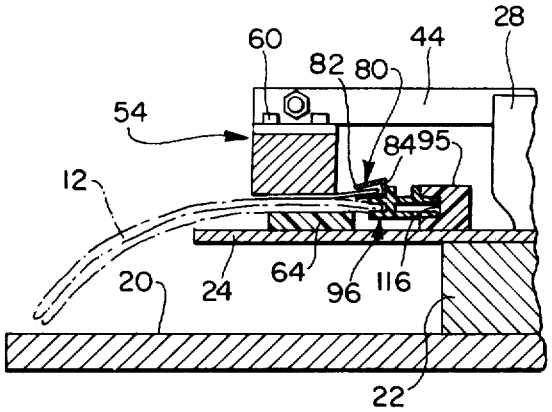
FIG. 2 is a sectional view of a portion of the imprinting device showing the location of the holder as embodied herein during the imprinting operation.

Referring to FIGS. 1 and 2, the imprinting device 94 includes a base generally indicated at 18 that is defined by a base board 20 to which a block 22 (FIG. 2) is secured at an end thereof. Also formed as part of the base 18 is a base plate 24 that is preferably formed of a metal material and that is secured to the block 22 and base board 20 by a bracket assembly 26 mounted on the upper surface of the base plate 24. As illustrated in FIG. 1, the bracket assembly 26 includes spaced apart walls 28 that extend in a vertical direction and to which horizontal flanges 30 are joined at right angles relative thereto. A bottom plate 32 bridges the space between the flanges 30 and cooperates with bolts 34 to fix the bracket assembly 26 to the base plate 24 and base board 20.

Mounted for pivotal movement on the bracket assembly 26 is a handle generally indicated at 36 that includes a bar 38 having a hand grip 39 formed on the outermost end thereof. Joined to the bar 38 in angular relation thereto is an elongated lever 40 that is defined at the inner end thereof by spaced portions 41, the spaced portions 41 being pivotally connected to the walls 28 of the bracket assembly 26 by a pin 42. As shown, the outermost ends of the spaced portions 41 are disposed in face-to-face engaging relation to define the elongated lever 40 as it is connected to the bar 38. Also mounted for pivotal movement between the spaced walls 28 of the bracket assembly 26 is a heating block support bar 44 that projects outwardly from between the walls 28 and is pivotally connected thereto by a pivot pin 46. An over-center connector 48 interconnects the support bar 44 to the lever 40 by means of the pivot pins 50 and 52, respectively.

Mounted on the outermost end of the heating block support bar 44 is a heating block generally indicated at 54 and that is formed with a heating surface 56. The heating block 54 is hollow for receiving a heating element therein to which current is supplied through an electrical lead 58. The heating block 54 is mounted on the outermost end of the support bar 44 by a bolt 60 that extends through the bar 44 and through brackets 62, the brackets 62 being fixed to the face of the heating block 54 that is opposite to the heating surface 56. An end plate 64 is also fixed to the heating block 54 and is removable therefrom to provide access to the interior of the member 54. As will be described, the heating block 54 is movable from the upper or inoperative position thereof as illustrated in FIG. 1 to a bottom or operative position illustrated in FIG. 2 upon pivotal movement of the handle 36 with respect to the bracket 26. Since the heating block 54 is interconnected to the handle 36, through the over-center connector 48 it will be moved to a positive locked position during the heating operation.

Mounted on the base plate 24 and spaced from the bracket assembly 26 is an elongated foam pad 64 that is substantially rectangular in cross sectional configuration. The pad 64 is located on the base plate 24 such that when the heating block 54 is moved to the lower position thereof, the heating surface 56 is disposed in overlying relation with respect to the upper face of the pad 64. As shown, the configuration of the upper face of the pad 64 is substantially the same as that of the heating surface 56 and thus accommodates substantially the full length of the surface 56 in the lower or operative position of the heating block. The pad 64 also defines the imprinting station and receives the article on which indicia is to be imprinted, as further illustrated in FIG. 2.

Since placement of a flexible article such as a duffel bag on the pad 64 that defines the imprinting station must be accomplished in a precise manner to positively locate and orient the article and the indicia to be imprinted thereon, a stop member 95 is provided. The stop member 95 is fixed directly to the base plate 24 and is disposed intermediate the pad 64 and the bracket assembly 26. As will be described, the stop member 95 is for use primarily as a stop for special kinds of flexible articles such as a tote bag, or duffel bag, and receives a combined holder and stop member generally indicated at 96. As shown more clearly in FIG. 3, the combined holder and stop member 96 is defined by an upper wall 98 from which a lower wall 100 is spaced. An internal longitudinally extending rib 102 divides the space between the upper wall 98 and lower wall into a wide slot 104 and a narrow slot 106. Joined to the upper surface of the upper wall 98 and extending the length thereof are spaced ribs 108 and 110 that are approximately equally spaced from the adjacent longitudinally extending edges of the upper wall 98 to define shelves 112 and 114 respectively. Each shelf 112 and 114 is formed so as to accommodate the indicia holder 80 thereon during the imprinting operation; and as further shown in FIGS. 1 and 2, the stop member 95 is formed with a longitudinally extending slot 116 that is dimensioned for receiving therein in supporting relation either edge of the member 96 that includes shelf 112 or shelf 114. As will be described below, when a tote bag is to be imprinted, the wide slot 104 faces outwardly of the stop member 95 for accommodating an edge of a tote bag, the shelf 112 having the word "TOTE" printed thereon to instruct the user of the device to insert the edge of a tote bag to be imprinted into the slot 116. Similarly, the narrow slot 106 accommodates the edge of a duffel bag therein, the shelf 114 being marked with the word "DUFFEL" thereon.

In order to locate the indicia that is to be transferred onto a flexible article such as a duffel or tote bag, an indicia holder or letter bar generally indicated at 80 is provided; and as illustrated in FIGS. 1 and 2, the indicia holder 80 is defined by an elongated plastic member having opposed jaws 82 that joined to a base 84. The jaws 82 are formed such that they engage at the outermost ends thereof; and since the holder is formed of a plastic material, the jaws 82 are separable to receive indicia strips 86 therebetween. The indicia strips 86 are formed of a special parchment paper that is especially treated on the upper surface thereof to receive a letter or number 87 thereon that provides for identification of the indicia to be transferred. The underside of the strips 86 are treated to receive a transfer ink that defines the indicia 88 and that is heat responsive wherein upon the application of heat thereto, the ink will be transferred onto a surface with which it is contact. A more complete description of the strips 86 appears in copending application Ser. No. 589,784.

Figure 3:
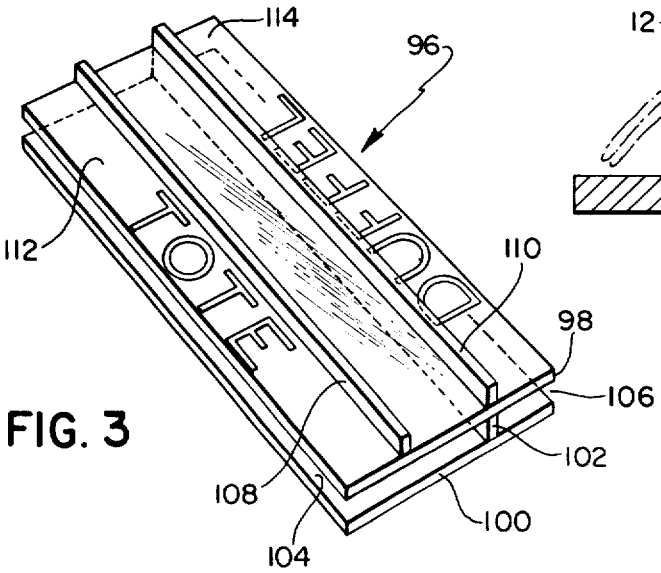
FIG. 3 is a perspective view of the holder that is utilized to positively locate the flexible article during the imprinting operation.

In use of the invention, it is first assumed that a duffel bag is to be imprinted with appropriate indicia thereon. The duffel bag is folded and then inserted into the narrow slot 106 of the member 96. With the heating block 54 located in the retracted position, the member 96 is mounted on the stop member 95 by inserting the end of the member 96 opposite to that in which the duffel bag is inserted into the slot 116, the rib 110 abutting against the outer marginal edge of the stop member 95. In the mounted position of the member 96 with the duffel bag inserted therein, the remaining portion of the duffel bag extends outwardly of the base plate 24, and overlies the pad 64 which defines the imprinting station. The indicia holder or letter bar 80 with the appropriate indicia carried thereby is placed on the exposed shelf 114 as illustrated in FIG. 3, the indicia strips overlying the upper surface of the duffel bag, and the indicia to be transferred being generally in alignment with the pad 64. The handle 36 is thereafter pivoted downwardly to force the heating surface of the heating block 54 into engagement with the indicia strips and the duffel bag, and a timer 91 may be utilized to audibly indicate the termination of the heating period to indicate to the operator that the indicia has been transferred to the bag and that the heating block 54 should be retracted. If is understood that the operation for imprinting indicia on a tote bag is similar to that just described, except that the member 96 is reversed in position on the stop member 95, wherein the wide slot 104 is exposed for receiving the tote bag therein, and the letter bar 80 carrying the appropriate indicia is thereafter placed on the shelf 112.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A holder for use in an imprinting device for imprinting indicia from indicia strips on a flexible article, comprising a first wall, a second wall spaced from said first wall in parallel relation thereto and means for positioning an article to be imprinted relative to said indicia strips, said means comprising a longitudinally extending rib joined to said first and second walls and separating said walls to define opposed longitudinally extending slots therein, said rib being located such that the depth of one slot is different from the depth of the other slot, the difference in depth of said slots providing for each slot locating said article relative to said imprinting device and accommodating an article of different shape and configuration therein on which indicia is to be imprinted.

2. A holder as claimed in claim 1, one of said walls having spaced longitudinally extending ribs joined thereto that are spaced from the adjacent longitudinally extending edge thereof, wherein oppositely located shelves are defined that receive a member thereon in which the indicia strips are mounted.

3. A holder for use in an imprinting device for imprinting indicia from indicia strips onto a flexible article, comprising a plate, a separating element fixed to said plate and separating the plate into at least two areas, said plate being selectively locatable such that a selected area thereon is exposed for receiving said flexible article thereon, said separating element defining a stop against which the flexible article abuts for locating said flexible article in a predetermined position during an imprinting operation, and means mounted on said plate for locating said indicia strips in oriented relation relative to said article, said locating means including a second plate spaced from said first named plate and having an upstanding rib joined thereto to define a space, and indicia holding means in which said indicia is received being locatable on said second plate in said space and in engagement with said upstanding rib for locating said indicia in oriented relation.

4. A holder as claimed in claim 3, said separating element separating said first named plate into unequal areas, one of which is exposed for receiving a flexible article of specified shape and characteristics thereon.

5. A holder as claimed in claim 4, a second upstanding rib joined to said second plate and spaced from said first named rib to form a second space, said second named space receiving said indicia holding means when the other of said unequal areas is exposed for receiving a different flexible article thereon of specified shape and characteristics.

6. A holder for use in an imprinting device for imprinting indicia from indicia strips onto the exterior surface of a panel of a flexible article such as a duffle or tote bag, comprising a plate, a separating element mounted on said plate and dividing the surfaces of said plate adjacent to said separating element into at least two areas, said separating element cooperating with each area to define a space on which a bag is located during an imprinting operation and forming a forward stop for the bag to locate the bag in an imprinting position, one of said areas being larger than the other so that a duffle or tote bag to be imprinted can be accommodated in a corresponding area for the imprinting thereon, said plate being selectively locatable on said imprinting device such that one of said areas thereon is readily exposed for receiving a bag thereon, and means mounted on said plate for locating said indicia strips in oriented relation relative to said article.

7. A holder as claimed in claim 6, said separating element being defined by a divider rib that extends longitudinally of said plate for separating said plate into said two areas.

* * * * *